US012722098B2

(12) United States Patent
Cai

(10) Patent No.: US 12,722,098 B2
(45) Date of Patent: Sep. 1, 2026

(54) BUBBLE BLOWING DEVICE

(71) Applicant: Cibo Cai, Shantou (CN)

(72) Inventor: Cibo Cai, Shantou (CN)

( * ) Notice: Subject to any disclaimer, the term of this patent is extended or adjusted under 35 U.S.C. 154(b) by 176 days.

(21) Appl. No.: 18/762,151

(22) Filed: Jul. 2, 2024

(65) Prior Publication Data

US 2026/0007982 A1 Jan. 8, 2026

(51) Int. Cl.

*A63H 33/28* (2006.01)
*A63H 29/22* (2006.01)
*A63H 31/00* (2006.01)

(52) U.S. Cl.

CPC ..... *A63H 33/28* (2013.01); *A63H 29/22* (2013.01); *A63H 31/00* (2013.01)

(58) Field of Classification Search

CPC ..... A63H 33/28; A63H 29/22; F16H 37/06; F16H 37/065

USPC ..... 446/15

See application file for complete search history.

(56) References Cited

U.S. PATENT DOCUMENTS 6,484,608 B1 * 11/2002 Ziavras ..... F24S 30/45 74/490.09
2004/0253899 A1 * 12/2004 Thai ..... A63H 33/28 446/15
2012/0270462 A1 * 10/2012 Lo ..... A63H 33/28 446/15
2023/0158419 A1 * 5/2023 Ruggiero ..... A63H 29/22 446/15
2023/0264113 A1 * 8/2023 Mei ..... A63H 33/28 446/16

FOREIGN PATENT DOCUMENTS

CN 217697930 U * 11/2022

* cited by examiner

*Primary Examiner* — Peter M Poon
(74) *Attorney, Agent, or Firm* — Hemisphere Law, PLLC

(57) ABSTRACT

A bubble blowing device includes a shell, an air guide disc, at least two solution-feeding tubes, a drive gear train, and a bubble solution bottle. The air guide disc is arranged in the shell. At least two solution supply nozzles are arranged on the air guide disc, and the solution-feeding tubes are connected to the corresponding solution supply nozzles respectively. A drive gear train is arranged in the shell, and is configured to drive the solution-feeding tubes to feed solution respectively. The bubble solution bottle is connected to the shell, and an end of each solution-feeding tube extends into the bubble solution bottle.

11 Claims, 8 Drawing Sheets

BUBBLE BLOWING DEVICE

TECHNICAL FIELD

The present invention relates to the field of toys for children, and specifically relates to a bubble blowing device.

BACKGROUND

Electric bubble blowing toys in the market can continuously blow out many bubbles, and therefore are very popular with children. A bubble blowing toy consists of a solution-feeding tube, a bubble solution bottle, a shell, a rotatable bubble disc, an air guide, a fan blade, a motor, a drive gear train, and the like. The rotatable bubble disc is provided with bubble solution-applying rings, the motor can drive the rotatable bubble disc to rotate through the drive gear train, and the air guide is provided with a solution supply nozzle. During rotation of the rotatable bubble disc, the bubble solution-applying rings pass through the corresponding solution supply nozzle in sequence, to be applied with bubble solution, and the fan blade is driven by the motor to rotate at a high speed to generate air flow, so that bubbles are blown out from the bubble solution-applying rings. The bubble blowing toy is usually provided with only one solution-feeding tube, one end of which is located in the bubble solution bottle and the other end of which is connected to the solution supply nozzle for feeding the solution to the solution supply nozzle. However, because only one solution-feeding tube sucks the solution from the bubble solution bottle, an amount of fed solution is small, making it impossible to arrange more bubble solution-applying rings on the rotatable bubble disc. As a result, when the bubble blowing toy operates, a few bubbles are blown out, and user's experience is mediocre.

In view of this, the present invention is proposed.

SUMMARY

The present invention provides a bubble blowing device.

The present application provides the following technical solution:

A bubble blowing device includes:

a shell;

an air guide disc, arranged in the shell, where the air guide disc is provided with at least two solution supply nozzles;

at least two solution-feeding tubes, connected to the corresponding solution supply nozzles respectively;

a drive gear train, arranged in the shell, and configured to drive the solution-feeding tubes to feed solution respectively; and a bubble solution bottle, connected to the shell, where an end of each of the solution-feeding tubes extends into the bubble solution bottle.

Optionally, the drive gear train includes at least two solution-feeding squeeze gears.

The solution-feeding tubes pass through the corresponding solution-feeding squeeze gears in a surrounding manner respectively.

The solution-feeding squeeze gears can rotate to squeeze the corresponding solution-feeding tubes to feed the solution.

Optionally, the bubble blowing device includes a motor, the drive gear train includes at least two side gear trains, and the motor and each of the side gear trains are both arranged in the shell.

The side gear train is provided with a plurality of gears, where the gears are arranged in sequence, adjacent gears are meshed, and one of the gears is the solution-feeding squeeze gear.

The motor is connected with a worm gear, and a gear at an input end of each of the side gear trains is meshed with the worm gear.

Optionally, the shell is provided with at least two accommodating grooves.

Each of the solution-feeding squeeze gears is provided with an eccentric shaft.

At least the eccentric shaft is located in the accommodating groove.

The solution-feeding tubes extend through the corresponding accommodating grooves respectively, and pass through the corresponding eccentric shafts in a surrounding manner respectively.

Optionally, the bubble blowing device includes a rotatable bubble disc and a transmission rod, where the rotatable bubble disc is rotatably connected to the shell, and a toothed ring is arranged on the rotatable bubble disc.

Both ends of the transmission rod are connected with a first gear and a second gear respectively, the first gear is meshed with a gear of one of the side gear trains, and the second gear is meshed with the toothed ring.

Optionally, the bubble blowing device includes a fan blade, the shell includes a cylindrical shell and a power shell, which are arranged in sequence, and the air guide disc and the rotatable bubble disc are both arranged in the cylindrical shell.

The power shell is connected to a side that is of the cylindrical shell and that is away from the rotatable bubble disc.

The motor and the drive gear train are both arranged in the power shell; and the fan blade is located in the cylindrical shell, and is in a transmissive connection with the motor.

Optionally, the power shell is connected to an opening edge of the cylindrical shell through a plurality of connecting ribs, and a hollow portion communicating with an internal cavity of the cylindrical shell is formed between adjacent connecting ribs.

Optionally, the rotatable bubble disc is provided with a plurality of bubble solution-applying components, where each of the bubble solution-applying components includes a plurality of bubble solution-applying rings which are arranged in a circumferential direction of the rotatable bubble disc in sequence, and the bubble solution-applying rings are located on a same circular track.

The bubble solution-applying components are arranged in a radial direction of the rotatable bubble disc in sequence.

During rotation of the rotatable bubble disc, each circle of bubble solution-applying rings on the rotatable bubble disc are in contact with the corresponding solution supply nozzle respectively.

Optionally, lengths of the solution supply nozzles are different, and the solution supply nozzles are arranged at intervals in the circumferential direction of the rotatable bubble disc in sequence.

Each of the solution supply nozzles extends from an outermost bubble solution-applying component to a side of a circle center of the rotatable bubble disc.

Optionally, the rotatable bubble disc is provided with three bubble solution-applying components.

Each of the solution supply nozzles includes any two or all of a first solution supply nozzle, a second solution supply nozzle, and a third solution supply nozzle.

The first solution supply nozzle only extends through the inside of the outermost bubble solution-applying component.

The second solution supply nozzle only extends through the inside of the outermost bubble solution-applying component and the inside of the middle bubble solution-applying component.

The third solution supply nozzle extends through the outermost bubble solution-applying component, the middle bubble solution-applying component, and the innermost bubble solution-applying component.

Optionally, the solution supply nozzle includes a main body and a cover, where the main body is connected to the air guide disc, and is provided with a solution reservoir and a connecting nozzle communicating with the solution reservoir, the solution reservoir and the connecting nozzle are located at both sides of the air guide disc in a thickness direction respectively, and the solution-feeding tube is connected to the connecting nozzle.

The cover is connected to the main body, and covers the solution reservoir.

The cover is provided with a through hole communicating with the solution reservoir, and an annular groove is provided around an edge of an outer surface of the cover.

The rotatable bubble disc is in contact with or close to the cover.

Optionally, an edge of a side that is of the main body and that is away from the cover is provided with a flange, where portions that are of the flange and that are located at both sides of the connecting nozzle are provided with notches.

By adopting the above technical solution, the present invention has the following beneficial effect:

According to the bubble blowing device provided in the present invention, the at least two solution-feeding tubes are arranged and each solution-feeding tube directly extends into the bubble solution bottle, to form at least two solution supply paths, so that more solution can be fed and more bubbles can be produced, making the bubble blowing device more interesting and bringing good experience to players.

Specific embodiments of the present invention will be further described in detail below with reference to the accompanying drawings.

BRIEF DESCRIPTION OF THE DRAWINGS

As a part of the present application, the accompanying drawings are used to provide a further understanding of the present invention, and illustrative embodiments of the present invention and description thereof are used to explain the present invention, but do not constitute an improper limitation on the present invention. Apparently, the accompanying drawings in the following description are merely some embodiments, and those of ordinary skill in the art can also obtain other accompanying drawings based on these accompanying drawings without making creative efforts. In the accompanying drawings.

Figure 1:
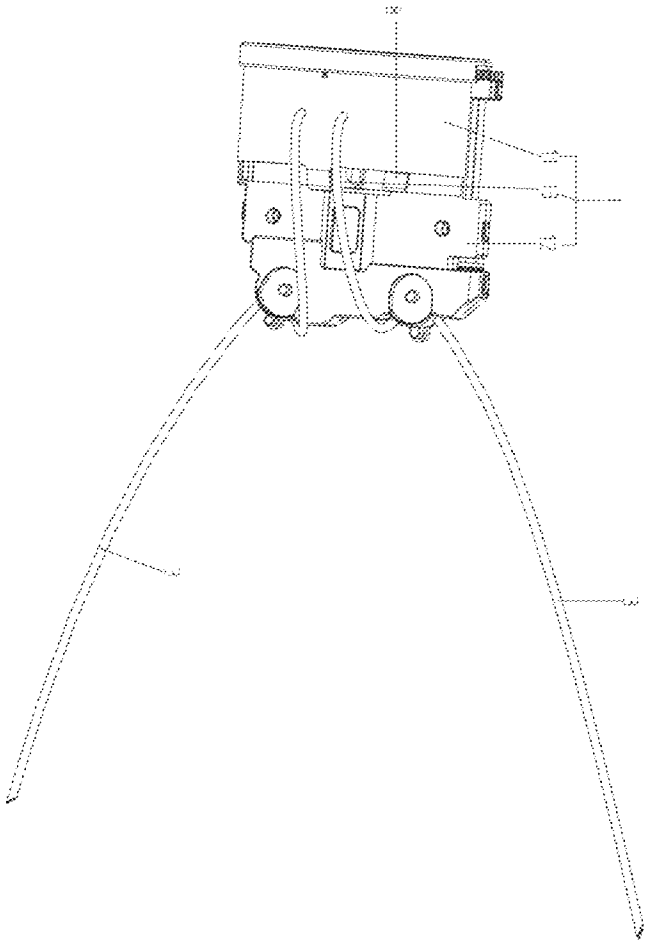
FIG. 1 is a schematic diagram of a partial structure of a bubble blowing device according to an embodiment of the present application.

Reference numerals: 1. Shell; 11. Cylindrical shell; 12. Power shell; 121. Accommodating groove; 13. Connecting rib; 2. Air guide disc; 21. First solution supply nozzle; 22. Second solution supply nozzle; 23. Third solution supply nozzle; 201. Main body; 2011. Solution reservoir; 2012. Connecting nozzle; 2013. Flange; 2014. Notch; 202. Cover; 2021. Through hole; 2022. Annular groove; 3. Solution-feeding tube; 4. Solution-feeding squeeze gear; 41. Eccentric shaft; 5. Motor; 51. Worm gear; 6. Rotatable bubble disc; 61. Bubble solution-applying ring; 7. Transmission rod; 71. First gear; 72. Second gear; and 8. Fan blade.

It should be noted that the accompanying drawings and written description are not intended to limit the concept scope of the present invention in any way, but rather to illustrate the concept of the present invention to those skilled in the art by reference to specific embodiments.

DESCRIPTION OF THE EMBODIMENTS

In order to make the objective, technical solution and advantages of the present invention clearer, the technical solution in embodiments will be clearly and completely described below with reference to the accompanying drawings in embodiments of the present invention. The following embodiments are intended to illustrate the present invention rather than limit the scope of the present invention.

In the description of the present invention, it should be noted that directions or positional relations indicated by terms, such as "upper", "lower", "internal", "external", and the like, are directions or positional relations shown in the accompanying drawings, which are merely intended to conveniently describe the present invention and simplify description rather than indicate or imply that the indicated device or components must have specific directions and be structured and operated according to the specific directions, and therefore should not be interpreted as limitations on the present invention.

In the description of the present disclosure, it should be noted that unless clearly specified and defined otherwise, terms, such as "mounting" and "connection", should be broadly comprehended as a fixed connection, a detachable connection, an integral connection, a mechanical connection, an electrical connection, a direct connection or an indirect connection through an intermediate. For those of ordinary skill in the art, specific meanings of the above terms in the present invention can be understood according to specific conditions.

Refer to FIG. 1 to FIG. 8. An embodiment of the present application provides a bubble blowing device, including a shell 1, an air guide disc 2, a drive gear train, a bubble solution bottle, and at least two solution-feeding tubes 3. The air guide disc 2 is arranged in the shell 1. At least two solution supply nozzles are arranged on the air guide disc 2, and the solution-feeding tubes 3 are connected to the corresponding solution supply nozzles respectively. The drive gear train is arranged in the shell 1, and is configured to drive the solution-feeding tubes 3 to feed solution respectively.

The bubble solution bottle is connected to the shell 1, and an end of each solution-feeding tube 3 extends into the bubble solution bottle. The drive gear train can drive the solution-feeding tubes 3, so that the solution-feeding tubes can suck bubble solution in the bubble solution bottle and feed it into the solution supply nozzles.

According to the bubble blowing device provided in the present application, the at least two solution-feeding tubes 3 are arranged and each solution-feeding tube 3 directly extends into the bubble solution bottle, to form at least two independent solution supply paths, so that more solution can be fed and more bubbles can be produced, making the bubble blowing device more interesting and bringing good experience to players.

In some possible embodiments, the drive gear train includes at least two solution-feeding squeeze gears 4, the solution-feeding tubes 3 pass through the corresponding solution-feeding squeeze gears 4 in a surrounding manner respectively, and the solution-feeding squeeze gears 4 can rotate to squeeze the corresponding solution-feeding tubes 3 to feed the solution.

The bubble blowing device includes a motor 5, which is in a transmissive connection with the drive gear train. When the motor 5 rotates, the drive gear train can be driven to drive the two solution-feeding squeeze gears 4 therein to rotate and squeeze the solution-feeding tubes 3, so that the solution in the solution-feeding tubes 3 flows towards the solution supply nozzle, to be jetted out. The solution-feeding squeeze gears 4 can keep rotating to repeatedly squeeze the solution-feeding tubes 3, so that the bubble solution in the bubble solution bottle can be continuously sucked by the solution-feeding tubes 3.

Figure 2:
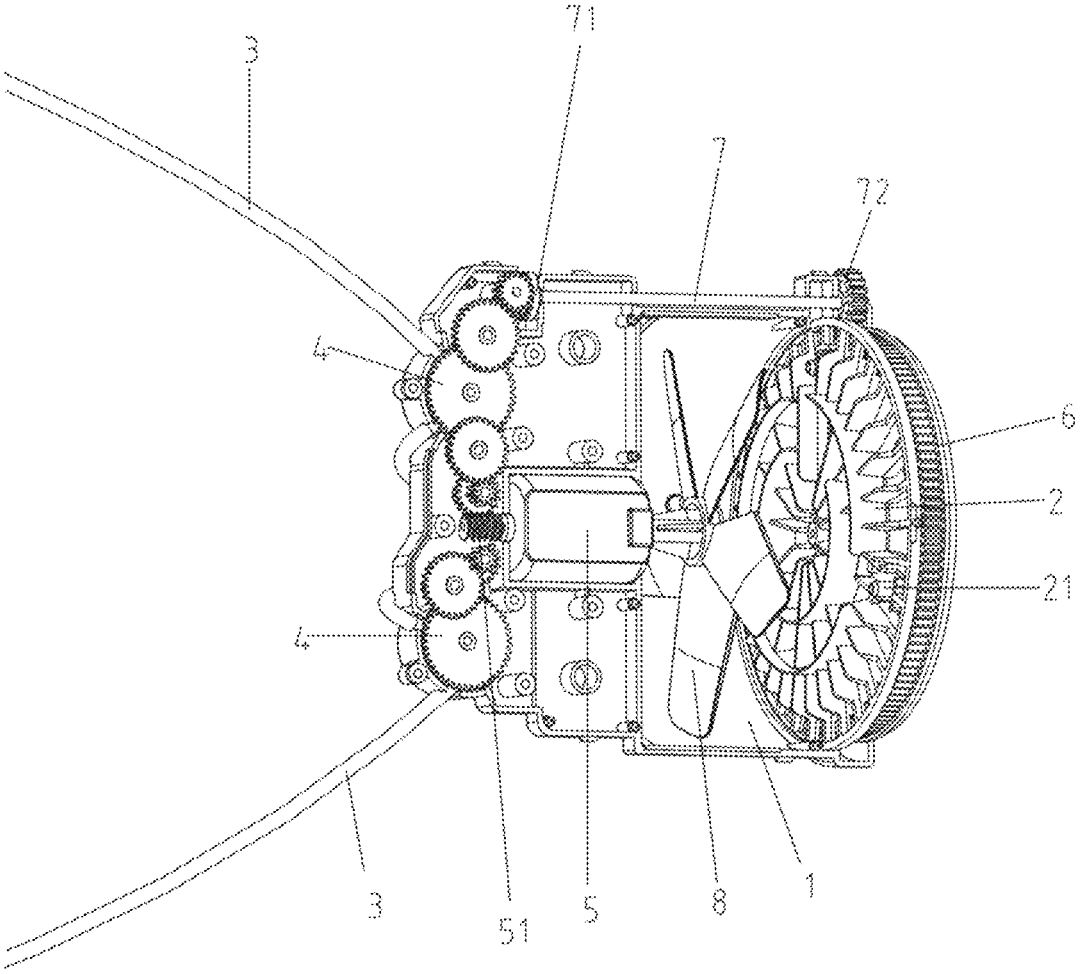
FIG. 2 is a schematic diagram of an internal structure of a bubble blowing device after one side of a shell is removed.
Figure 3:
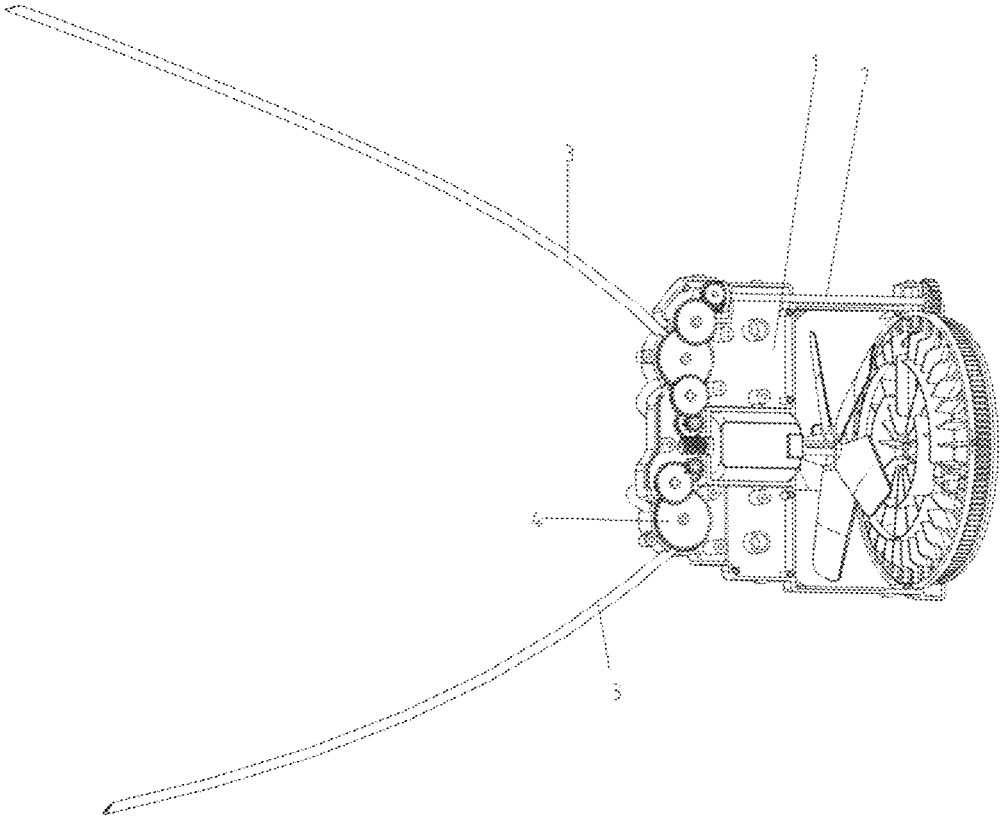
FIG. 3 is a schematic diagram of a structure obtained after a solution-feeding squeeze gear in FIG. 2 is removed.
Figure 4:
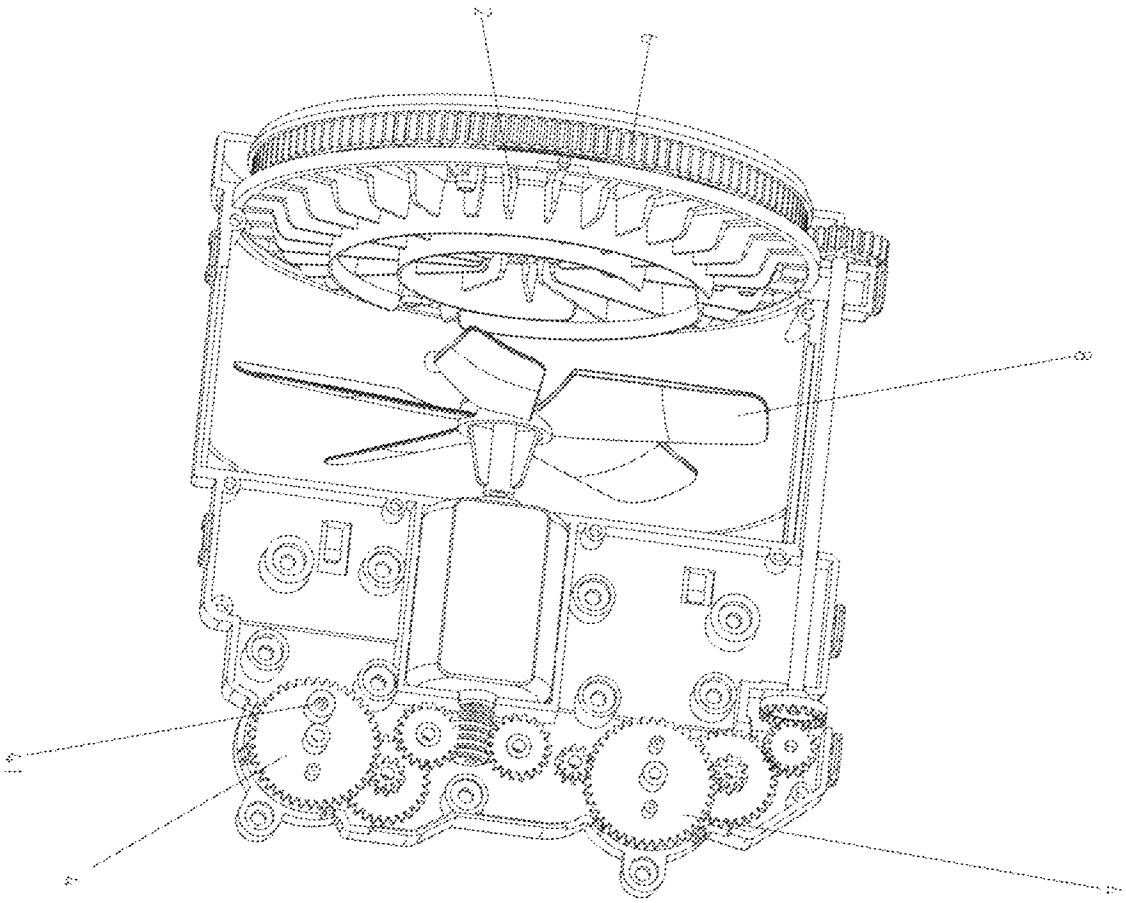
FIG. 4 is a schematic diagram of an internal structure of a bubble blowing device after the other side of the shell is removed.

In some possible embodiments, as shown in FIG. 2 and FIG. 3, the shell 1 is provided with at least two accommodating grooves, each solution-feeding squeeze gear 4 is provided with an eccentric shaft 41, at least the eccentric shaft 41 is located in the accommodating groove, the solution-feeding tubes 3 extend through the corresponding accommodating grooves respectively, and the solution-feeding tubes 3 pass through the corresponding eccentric shafts 41 in a surrounding manner respectively. The solution-feeding squeeze gears 4 can rotate to drive the eccentric shafts 41 to squeeze the solution-feeding tubes 3, thus realizing solution feeding by driving. It should be noted that working principles of the solution-feeding squeeze gears 4 and the solution-feeding tubes 3 are the mature prior art, and do not pertain to the inventive points of the present application as well, so the present application does not limit them.

In some possible embodiments, the bubble blowing device includes the motor 5, the drive gear train includes at least two side gear trains, and the motor 5 and each side gear train are both arranged in the shell 1. Each side gear train is provided with a plurality of gears, the gears are arranged in sequence, adjacent gears are meshed, and one of the gears is the solution-feeding squeeze gear 4. The motor 5 is connected with a worm gear 51, and a gear at an input end of each side gear train is meshed with the worm gear 51.

In the present application, the motor 5 needs to drive two sets of drive gear trains to operate at the same time, and adopts a gear-worm transmission fit mode to reduce power output of the motor 5. Compared with pure gear transmission, the transmission of the worm gear 51 has a greater reduction ratio and can also achieve a greater output torque. Consequently, usage of gears can be reduced, noise generated in a transmission process can be reduced, and durability is better than that of full gear reduction as well.

In some possible embodiments, the bubble blowing device includes a rotatable bubble disc 6 and a transmission rod 7. The rotatable bubble disc 6 is rotatably connected to the shell 1, and a toothed ring is arranged on the rotatable bubble disc 6. Both ends of the transmission rod 7 are connected with a first gear 71 and a second gear 72 respectively, the first gear 71 is meshed with a gear of one of the side gear trains, and the second gear 72 is meshed with the toothed ring. The operation of the drive gear train can drive the transmission rod 7 to rotate, so that the transmission rod 7 can drive the rotatable bubble disc 6 to rotate.

In some possible embodiments, the bubble blowing device includes a fan blade 8, and the shell 1 includes a cylindrical shell 11 and a power shell 12, which are arranged in sequence. The air guide disc 2 and the rotatable bubble disc 6 are both arranged in the cylindrical shell 11, and the power shell 12 is connected to a side that is of the cylindrical shell 11 and that is away from the rotatable bubble disc 6. The motor 5 and the drive gear train are both arranged in the power shell 12. The fan blade 8 is located in the cylindrical shell 11, and is in a transmissive connection with the motor 5. A rotary shaft of the motor 5 penetrates through the shell 1 of the motor 5, and both ends of the rotary shaft are connected with the worm gear 51 and the fan blade 8 respectively.

In some possible embodiments, as shown in FIG. 1, the power shell 12 is connected to an opening edge of the cylindrical shell 11 through a plurality of connecting ribs 13, and a hollow portion communicating with an internal cavity of the cylindrical shell 11 is formed between adjacent connecting ribs 13. During high-speed rotation of the fan blade 8, outside air can enter the cylindrical shell 11 via the hollow portion and ultimately be exhausted by the rotatable bubble disc 6. The hollow portion is arranged to make an air path unobstructed.

Figure 5:
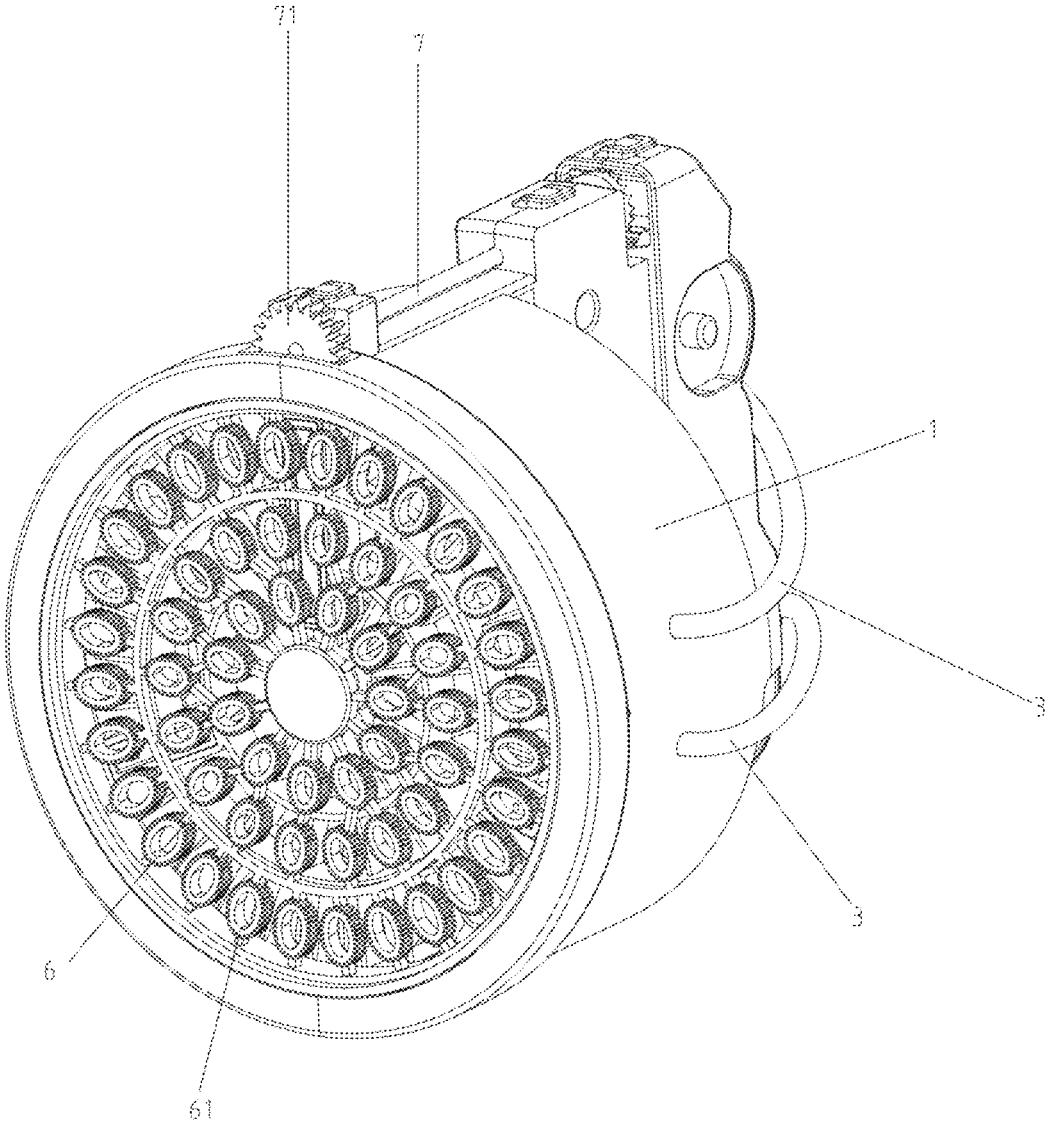
FIG. 5 is a diagram of a partial structure of a bubble blowing device from another angle of view.

In some possible embodiments, as shown in FIG. 5, the rotatable bubble disc 6 is provided with a plurality of bubble solution-applying components. Each bubble solution-applying component includes a plurality of bubble solution-applying rings 61 which are arranged in a circumferential direction of the rotatable bubble disc 6 in sequence, and the bubble solution-applying rings 61 are located on a same circular track. The bubble solution-applying components are arranged in a radial direction of the rotatable bubble disc 6 in sequence. During rotation of the rotatable bubble disc 6, each circle of bubble solution-applying rings 61 on the rotatable bubble disc 6 are in contact with the corresponding solution supply nozzle respectively. In embodiments of the present application, there are a large number of solution-feeding tubes 3, so a plurality of circles of bubble solution-applying rings 61 may be arranged correspondingly, thus increasing a number of produced bubbles.

In some possible embodiments, lengths of all the solution supply nozzles are different, the solution supply nozzles are arranged at intervals in the circumferential direction of the rotatable bubble disc 6 in sequence, and each solution supply nozzle extends from a bubble solution-applying component on an outermost circle to a side of a circle center of the rotatable bubble disc 6. Since the number of the outer circle of bubble solution-applying rings 61 is larger than the number of the inner circle of bubble solution-applying rings 61, in the present application, through the specific setting of the length of each solution supply nozzle, the number of the solution supply nozzles for applying the bubble solution onto the corresponding outer circle of bubble solution-applying rings 61 is also larger, so that the fed solution amounts and solution feeding frequencies of the outer circle of bubble solution-applying rings and the inner circle of bubble solution-applying rings are relatively balanced.

Figure 6:
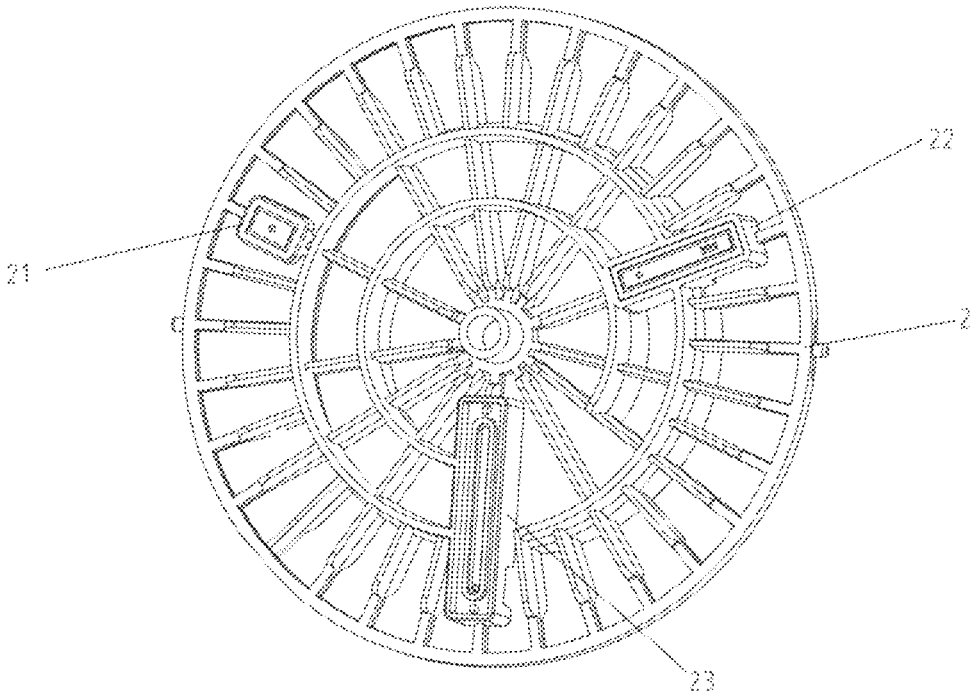
FIG. 6 is a schematic diagram a structure of a side that is of an air guide disc of a bubble blowing device and that faces a rotatable bubble disc.

In some possible embodiments, as shown in FIG. 5 and FIG. 6, the rotatable bubble disc 6 is provided with three bubble solution-applying components, which form three circles of bubble solution-applying rings from inside to outside. Each of the solution supply nozzles includes any two or all of a first solution supply nozzle 21, a second solution supply nozzle 22, and a third solution supply nozzle 23. The first solution supply nozzle 21 only extends through the inside of the outermost bubble solution-applying component, and can apply the solution onto the outermost circle of bubble solution-applying rings. The second solution supply nozzle 22 only extends through the inside of the outermost bubble solution-applying component and the inside of the middle bubble solution-applying component, and the first solution supply nozzle 21 can apply the solution onto the outermost circle of bubble solution-applying rings and the middle circle of bubble solution-applying rings. The third solution supply nozzle 23 extends through the outermost bubble solution-applying component, the middle bubble solution-applying component, and the innermost bubble solution-applying component. The third solution supply nozzle 23 can apply the solution onto the outermost circle of bubble solution-applying rings, the middle circle of bubble solution-applying rings, and the innermost circle of bubble solution-applying rings.

Figure 7:
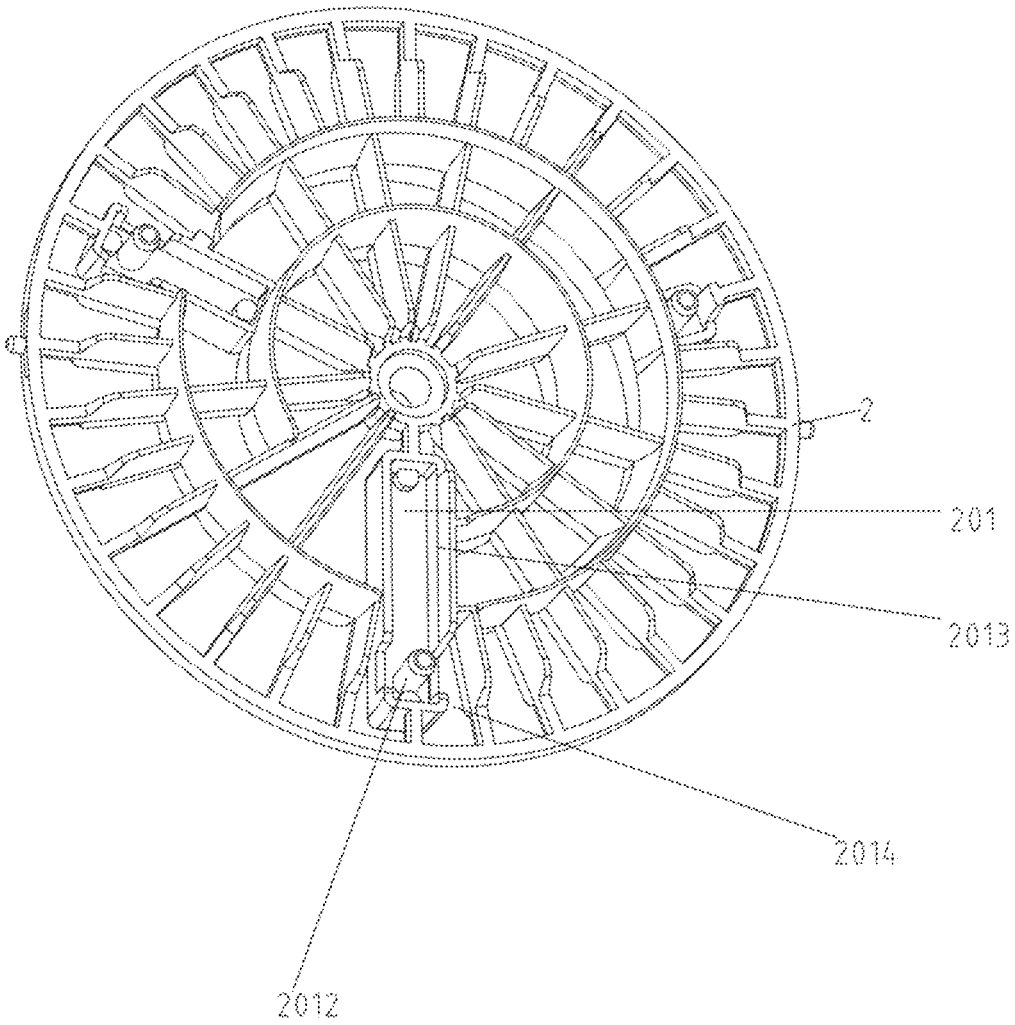
FIG. 7 is a schematic diagram of a structure of a side of an air guide disc that is of a bubble blowing device and that is away from a rotatable bubble disc.
Figure 8:
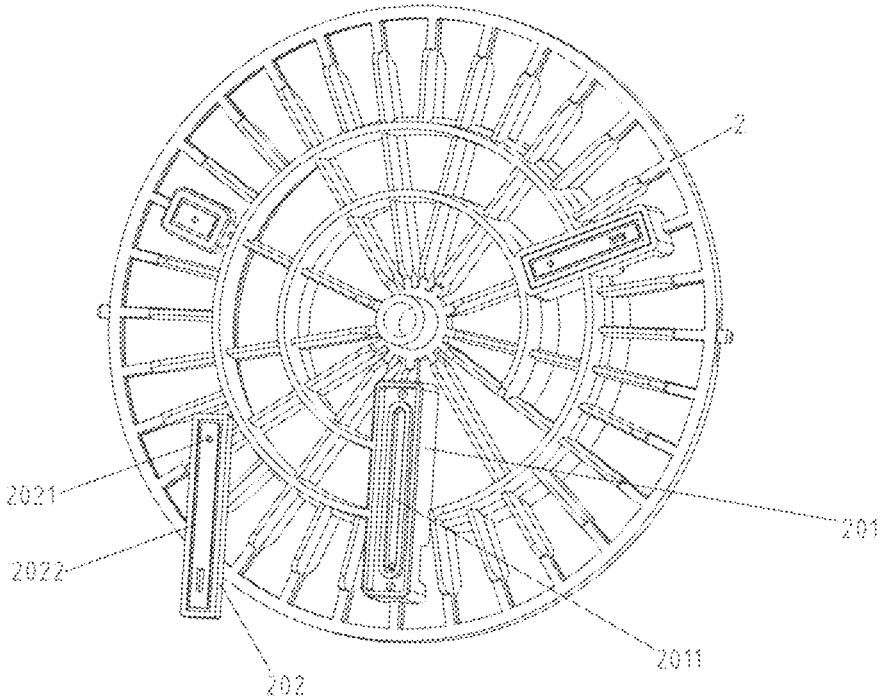
FIG. 8 is a schematic diagram when a cover on an air guide disc of a bubble blowing device is in a separated state.

Optionally, as shown in FIG. 6 to FIG. 8, the solution supply nozzle includes a main body 201 and a cover 202. The main body 201 is connected to the air guide disc 2. The main body 201 is provided with a solution reservoir 2011 and a connecting nozzle 2012 communicating with the solution reservoir 2011, and the solution reservoir 2011 and the connecting nozzle 2012 are located at two sides of the air guide disc 2 in a thickness direction respectively. The solution-feeding tube 3 is connected to the connecting nozzle 2012. The cover 202 is connected to the main body 201, and covers the solution reservoir 2011. The cover 202 is provided with a through hole 2021 communicating with the solution reservoir 2011, and an annular groove 2022 is provided around an edge of an outer surface of the cover 202. The rotatable bubble disc 6 is in contact with or close to the cover 202. The solution in the solution-feeding tube 3 can be injected into the connecting nozzle 2012 and then flow into the solution reservoir 2011 from the connecting nozzle 2011. The bubble solution in the solution reservoir 2011 flows out of the through hole 2021 and enters the annular groove 2022, so that the bubble solution can be applied onto the bubble solution-applying ring when the bubble solution-applying ring is in contact with the cover 202.

In some possible embodiments, an edge of a side that is of the main body 201 and that is away from the cover 202 is provided with a flange 2013, and portions that are of the flange 2013 and that are located at both sides of the connecting nozzle 2012 are provided with notches 2014. The notches 2014 are arranged to avoid the connecting nozzles 2012, so that ends of the solution-feeding tubes 3 can be conveniently sleeved onto the connecting nozzles 2012 by manual or equipment operation.

The above are only preferred embodiments of the present invention, and are not intended to limit the present invention in any from. Although the present invention has been disclosed as above with the preferred embodiments, the preferred embodiments are not intended to limit the present invention. Any person skilled in the art familiar with this patent may make use of the technical content disclosed above to make some alterations or modifications to equivalent embodiments with equivalent changes without departing from the scope of the technical solution of the present invention. Any simple modification, equivalent change and alteration made to the above embodiments according to the technical essence of the present invention without departing from the content of the technical solution of the present invention shall still fall within the scope of the solution of the present invention.

What is claimed is:

1. A bubble blowing device, comprising:

a shell;

an air guide disc, arranged in the shell, wherein the air guide disc is provided with at least two solution supply nozzles;

at least two solution-feeding tubes, one end of each of the at least two solution-feeding tubes being connected to the corresponding solution supply nozzles respectively, another end of each of the at least two solution-feeding tubes being configured to suck solution from a bubble solution bottle connected to the shell; and a drive gear train, arranged in the shell, and configured to drive the at least two solution-feeding tubes to feed the solution to the at least two solution supply nozzles respectively;

wherein the bubble blowing device further comprises a rotatable bubble disc rotatably connected to the shell; the rotatable bubble disc is provided with a plurality of bubble solution-applying components arranged in a radial direction of the rotatable bubble disc in sequence; lengths of the solution supply nozzles are different, and the solution supply nozzles are arranged at intervals in the circumferential direction of the rotatable bubble disc in sequence; and each of the solution supply nozzles extends from an outermost one of the bubble solution-applying components to a side of a circle center of the rotatable bubble disc.

2. The bubble blowing device according to claim 1, wherein the drive gear train comprises at least two solution-feeding squeeze gears;

the at least two solution-feeding tubes pass through the at least two solution-feeding squeeze gears in a surrounding manner respectively; and the at least two solution-feeding squeeze gears can rotate to squeeze the corresponding at least two solution-feeding tubes to feed the solution to the at least two solution supply nozzles respectively.

3. The bubble blowing device according to claim 2, comprising a motor, wherein the drive gear train comprises at least two side gear trains, and the motor and each of the side gear trains are both arranged in the shell;

the side gear traineach of the at least two side gear trains is provided with a plurality of gears, wherein the plurality of gears are arranged in sequence, two adjacent gears of the plurality of gears are meshed with each other, and one of the gears is the solution-feeding squeeze gear; and the motor is connected with a worm gear, and a gear at an input end of each of the side gear trains is meshed with the worm gear.

4. The bubble blowing device according to claim 3, wherein the shell is provided with at least two accommodating grooves;

each of the solution-feeding squeeze gears is provided with an eccentric shaft;

at least one of the eccentric shafts is located in the accommodating groove; and the solution-feeding tubes extend through the corresponding accommodating grooves respectively, and pass through the corresponding eccentric shafts in a surrounding manner respectively.

5. The bubble blowing device according to claim 4, further comprising a transmission rod, wherein a toothed ring is arranged on the rotatable bubble disc; and both ends of the transmission rod are connected with a first gear and a second gear respectively, the first gear is meshed with a gear of one of the side gear trains, and the second gear is meshed with the toothed ring.

6. The bubble blowing device according to claim 5, comprising a fan blade, wherein the shell comprises a cylindrical shell and a power shell, which are arranged in sequence, and the air guide disc and the rotatable bubble disc are both arranged in the cylindrical shell;

the power shell is connected to a side that is of the cylindrical shell and that is away from the rotatable bubble disc;

the motor and the drive gear train are both arranged in the power shell; and the fan blade is located in the cylindrical shell, and is in a transmissive connection with the motor.

7. The bubble blowing device according to claim 6, wherein the power shell is connected to an opening edge of the cylindrical shell through a plurality of connecting ribs, and a hollow portion communicating with an internal cavity of the cylindrical shell is formed between adjacent connecting ribs of said plurality of connecting ribs.

8. The bubble blowing device according to claim 7, wherein each of the bubble solution-applying components comprises a plurality of bubble solution-applying rings which are arranged in a circumferential direction of the rotatable bubble disc in sequence, and the bubble solution-applying rings are located on a same circular track;

and during rotation of the rotatable bubble disc, each circle of bubble solution-applying rings on the rotatable bubble disc are in contact with the corresponding solution supply nozzle respectively.

9. The bubble blowing device according to claim 8, wherein the plurality of bubble solution-applying components comprises three bubble solution-applying components;

each of the solution supply nozzles comprises any two or all of a first solution supply nozzle, a second solution supply nozzle and a third solution supply nozzle;

the first solution supply nozzle only extends through an inside of the outermost bubble solution-applying component;

the second solution supply nozzle only extends through the inside of the outermost bubble solution-applying component and an inside of the middle bubble solution-applying component; and the third solution supply nozzle extends through the outermost bubble solution-applying component, the middle bubble solution-applying component, and an innermost bubble solution-applying component.

10. The bubble blowing device according to claim 9, wherein each of the solution supply nozzles comprises a main body and a cover, the main body is connected to the air guide disc, and is provided with a solution reservoir and a connecting nozzle communicating with the solution reservoir, the solution reservoir and the connecting nozzle are located at both sides of the air guide disc in a thickness direction respectively, and at least one of the solution-feeding tubes is connected to the connecting nozzle;

the cover is connected to the main body, and covers the solution reservoir;

the cover is provided with a through hole communicating with the solution reservoir, and an annular groove is provided around an edge of an outer surface of the cover; and the rotatable bubble disc is in contact with or close to the cover.

11. The bubble blowing device according to claim 10, wherein an edge of a side that is of the main body and that is away from the cover is provided with a flange, and portions that are of the flange and that are located at both sides of the connecting nozzle are provided with notches.

* * * * *